US009114968B2

(12) United States Patent
Manger

(10) Patent No.: US 9,114,968 B2
(45) Date of Patent: Aug. 25, 2015

(54) GRAB OPENER FOR CROWN BOTTLE CAPS

(71) Applicant: Mark Andrew Manger, Missoula, MT (US)

(72) Inventor: Mark Andrew Manger, Missoula, MT (US)

( * ) Notice: Subject to any disclaimer, the term of this patent is extended or adjusted under 35 U.S.C. 154(b) by 210 days.

(21) Appl. No.: 13/927,115

(22) Filed: Jun. 26, 2013

(65) Prior Publication Data

US 2015/0000471 A1 Jan. 1, 2015

(51) Int. Cl.
*B67B 7/16* (2006.01)
*B67B 7/40* (2006.01)

(52) U.S. Cl.
CPC . *B67B 7/16* (2013.01); *B67B 7/403* (2013.01); *B67B 2007/166* (2013.01)

(58) Field of Classification Search
CPC ..... B67B 7/16; B67B 2007/166
See application file for complete search history.

(56) References Cited

U.S. PATENT DOCUMENTS

| | | | | | |
|---|---|---|---|---|---|
| 2,542,329 | A * | 2/1951 | Hammond, Jr. | ..... | 81/3.57 |
| D215,807 | S * | 11/1969 | Weingardt | ..... | D8/40 |
| 3,495,284 | A * | 2/1970 | Weingardt | ..... | 7/152 |
| 6,742,414 | B1 * | 6/2004 | Brailsford et al. | ..... | 81/3.55 |
| 6,786,113 | B2 * | 9/2004 | Brailsford et al. | ..... | 81/3.55 |
| 2006/0219058 | A1 * | 10/2006 | Farentinos et al. | ..... | 81/3.55 |
| 2010/0288080 | A1 * | 11/2010 | Babusiaux | ..... | 81/3.4 |
| 2011/0041655 | A1 * | 2/2011 | Muniz | ..... | 81/3.08 |

* cited by examiner

*Primary Examiner* — David B Thomas

(57) ABSTRACT

A device for opening bottles and cans that is designed to efficiently engage and remove crown bottle caps through the single motion of grabbing a bottle with one hand, consisting of metal, wood, plastic or other composite material 100, configured as a lever with a ring 103 joined to a finger platform 101 with a rocker 102 opposite an inverted hook 106 with a flat area to seat the bottle cap 104, a tapered point 107, and a magnet 105.

3 Claims, 3 Drawing Sheets

GRAB OPENER FOR CROWN BOTTLE CAPS

CROSS REFERENCE TO RELATED APPLICATIONS

This application claims the benefit of provisional patent application No. 61/673,207 filed Jul. 18, 2012 by the present inventor.

FEDERALLY SPONSORED RESEARCH

Not applicable

SEQUENCE LISTING OR PROGRAM

Not applicable

BACKGROUND

Prior Art

| | | | |
|---|---|---|---|
| 2,155,947 | Bottle Opener | Apr. 25, 1939 | Low |
| 2006/0219058 | Bottle Opener | Oct. 5, 2006 | Farentinos |
| WO2008/124894 | Bottle Opening Device | Oct. 23, 2008 | Babusiaux |
| D663176 | Bottle Opener | Jul. 10, 2012 | Dixon |
| 6,761,088 | Bottle Opener | Jul. 13, 2004 | Sasso |
| 7,165,475 | Bottle Opener | Jan. 23, 2007 | Teppe |
| 7,966,910 | Ring Styled Bottle Opener | Jun. 28, 2011 | Cece |
| D420265 | Bottle Opener | Feb. 08, 2000 | Pierce |
| 2,933,957 | Wall Mounted Bottle Opener | Apr. 26, 1960 | Wendlandt |

BACKGROUND OF THE INVENTION

Prior Art

Bottle openers are widely used and come in a variety of forms that function satisfactorily for most people. Drink servers and individuals with some upper extremity limitations are two of the groups who have particular needs that have not been fully met by previous bottle opening devices. Openers like Pierce's (D420265) have been the most popular available in the service industry because they use a single motion with each of two hands to remove the cap: one hand grabs the bottle while the other hand directs the opener across the cap to remove it. Wall mounted devices as shown by Wendlandt (U.S. Pat. No. 2,933,957) make opening a bottle a one-handed task, but lacks mobility because it is bolted to a wall. Portable, wearable devices as taught by Teppe (U.S. Pat. No. 7,165,475), Sasso (U.S. Pat. No. 6,761,088) and Cece (U.S. Pat. No. 7,966,910) are compact and are worn on a finger or hand. But these openers require a second hand to steady the bottle, moreover, these openers can be uncomfortable and cause scratches and bruising if used for prolonged periods. These openers often put the bartenders hand into direct contact with the mouth of the bottle causing sanitation concerns.

Low first described a one-handed squeeze type opener (U.S. Pat. No. 2,155,947). This bottle opener and its descendents, like Dixon (D663176), are one-handed, but are not efficient for service professionals. Despite the Low type opener's one-handedness, it requires three distinct actions with that hand: placing the opener on the cap; repositioning the hand to squeeze; and a motion to move the opener clear of the bottle's mouth. Farentinos teaches an opener that can be operated with one hand (2006/0219058/abandoned). It has a ring for the index finger and beyond the ring, an optional platform for the middle finger. However, the configuration of the Farentinos opener requires use of the thumb to position and manipulate the opener to remove the cap. This can make it a difficult device for those with more limited use of their hands. The Babusiaux opener (WO2008/124894 & 2010/0288080) is a one-handed opener that uses a motion from the wrist. It is, however, a device that is too bulky to be carried comfortably in a pocket and is not very fast to operate. The Babusiaux, as well as the Farentinos opener both bend caps to remove them. This is a negative quality to cap collectors.

Among existing openers, there are several common disadvantages:

a) They require multiple and inefficient actions to remove the cap.

b) Most are either: bulky, stationary, or painful when used repeatedly.

c) Most of the one-handed type openers are not designed to swing adequately away from the mouth of the bottle for pouring or drinking.

d) Existing openers cannot open bottles in a single motion with a single hand.

e) Existing one-handed openers do not integrate a can tab opener in the design.

f) Existing one-handed openers have not adapted a magnet in a way that allows it to store itself on a steel surface.

BACKGROUND OF INVENTION

Advantages

The Grab Opener distinguishes itself as a significantly more efficient, compact, and versatile improvement over existing devices. Using motion and force from an action with the intent of grabbing a bottle, to achieve the additional result of removing the cap, and the ability to easily pry pull-tabs on cans, makes the configuration of the Grab Opener unusually unique and desirable for drink service professionals, beverage enthusiasts, and the manually impaired. It offers many advantages:

a) It is uniquely designed to engage, remove, and clear a cap from a bottle's opening through a single, natural grabbing motion of one hand. This makes it a practical tool for individuals with upper extremity impairments, and food service professionals alike.

b) It is configured to easily leverage pull-tabs on cans.

c) Stays on the finger when switched between bottle opener and can tab puller.

d) Is compact in design to be comfortable to carry in a pants pocket.

e) The magnet that helps position it on the cap, and retain the cap when it is removed, will also secure itself on a steel surface when not in use.

f) A Grab Opener can be used in each hand to open two bottles at once.

g) Appeals to cap collectors by not bending bottle caps to remove them.

h) It produces an audible, showman-like pop when the cap is removed.

i) Is designed to stay loose and comfortable on the hand during extended use.

This invention has been marketed through the website www.gropener.com under the benefit of its provisional patent (61/673,207). Nearly 2,000 units sold in the first 3 months of release, indicating that it is commercially viable.

SUMMARY

In accordance with one embodiment, a Grab Opener comprises a body of alloy with a hook and area to seat the cap, opposite a finger ring connected to a finger platform above a curved rocker surface. It has adequate thickness to allow stability when fingers are in the ring and on the finger platform. A magnet securely engages the cap and also allows the opener to stow away on a steel surface.

DRAWINGS

Figures

REFERENCE NUMBERS

Figure 1:
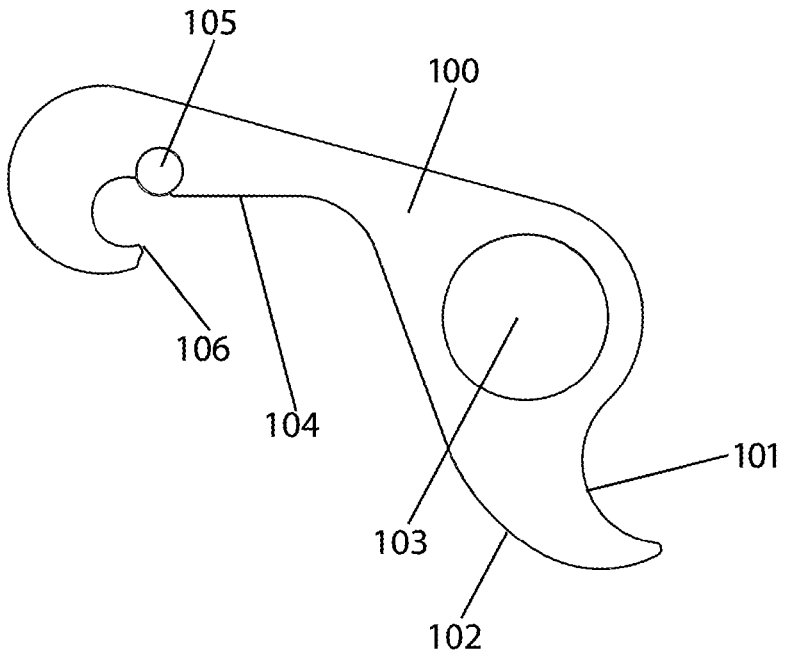
FIG. 1 shows a side view

100 Body of the opener
101 Finger platform
102 Rocker
103 Ring opening
104 Flat cap seat
105 Magnet
106 Hook
107 Taper

DESCRIPTION OF THE INVENTION

The body of this device is made from a rigid material, such as metal, plastic or wood 100. The body of the opener is comprised of: a finger platform 101 with a rocker underneath 102; a ring opening 103 approximately ⅞" in diameter; A flat area approximately 1" long 104 to seat the bottle cap; A hook 106 opposite the ring and rocker that descends approximately 9/32" below the 1" horizontal area. This hook turns back toward the ring and rocker and is about 3/32" deep. Between the hook lip and the cap seat area, a magnet 105 may be included. The overall length is approximately 3" long and about 2" tall. The opener can be around ½" wide.

Figure 3A:
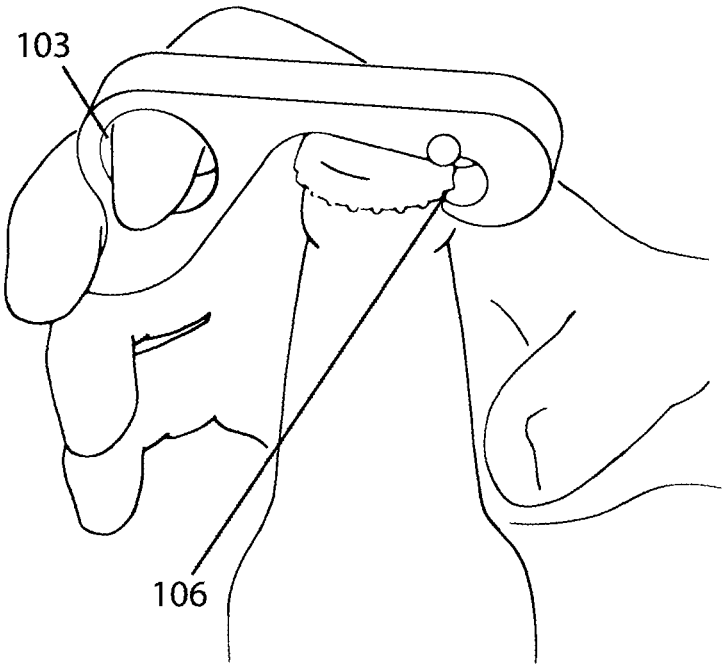
FIG. 3A shows the opener engaging the cap before the hand grabs the bottle
Figure 3B:
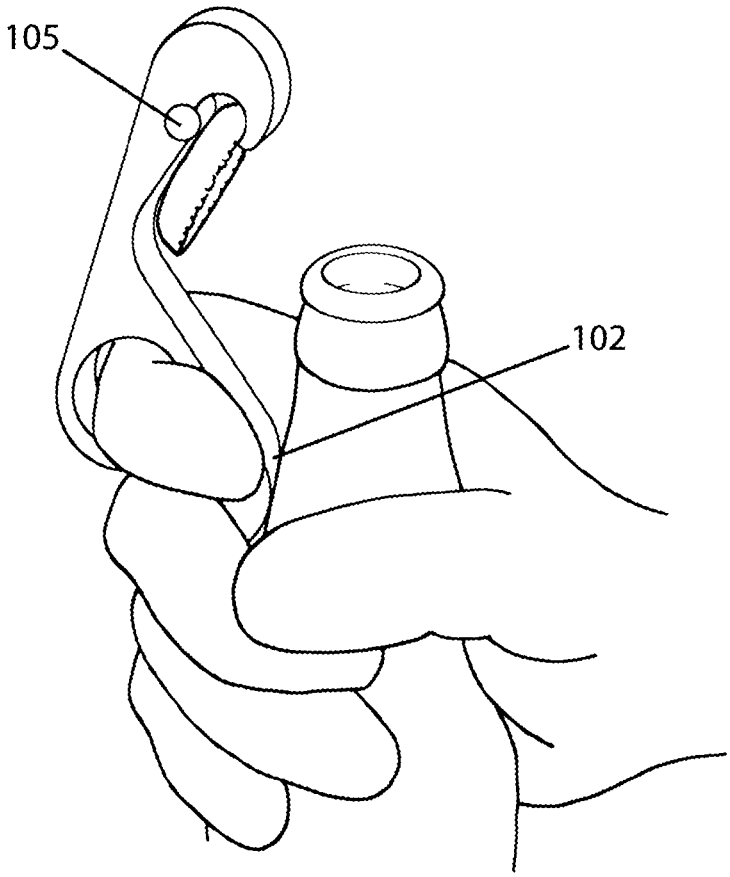
FIG. 3B shows the cap swinging away from the bottle's mouth as it is grabbed.

To operate, place the index finger part-way in the ring opening 103 while the middle finger rest on the finger platform 102. The device will hang loosely on the index finger while the middle finger passively supports the pitch of the hook 106 end, this keeps it in a position parallel to the cap when the hand is held in a relaxed and open position as shown in FIG. 3A. As the hand descends on the bottle, a horizontally placed cylindrical magnet 105 with its poles parallel to the hook, will pull itself towards the center of the cap, putting the hook into position under the cap's edge. As the hand grasps the bottle, the cap is popped off and the force of the users grip pressing the rocker 102 against the bottle swings the cap and opener out of the way of the bottle's mouth as illustrated in FIG. 3B. The width of the opener makes it stable when balanced on the fingers and comfortable to squeeze.

Figure 2:
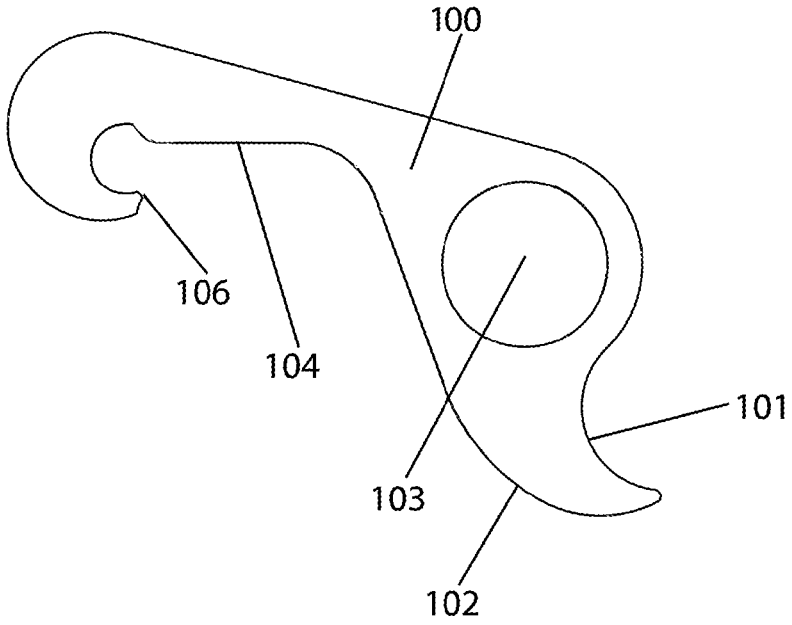
FIG. 2 shows a side view of opener without a magnet

The version shown in FIG. 2 eliminates the magnet. This uses the same single motion as the magnet version.

Figure 4:
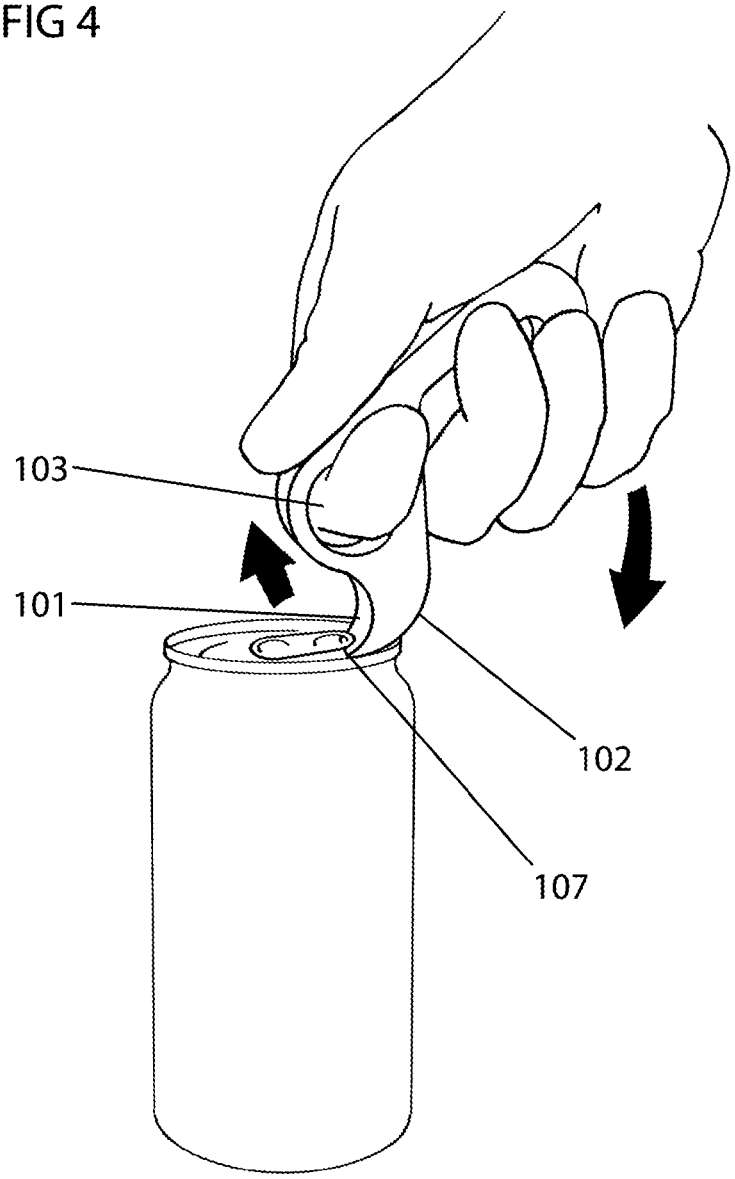
FIG. 4 shows the device being used to pry a pull-tab on a can.

FIG. 4 shows how the device is used as a lever for pull-tabs on canned beverages. From the bottle opening position, leave the index finger in the ring 103, remove the middle finger from the finger platform 101, and grip the hook end of the opener. With the finger platform 101 and rocker 102 facing out and down, tuck the tapered end 107 of the platform and rocker under the tab and gently push down on the opener. The rocker will force the tapered end and tab up, opening the can.

As the reader can see, the Grab Opener is an improved bottle cap remover that is useful for individuals with a single functioning hand, and desirable as an efficient, fast, and compact opener for service professionals and beverage enthusiasts. Its configuration allows it to function in a unique way for a hand-operated tool: It hangs passively on the fingers while it efficiently converts the motion of grabbing a bottle, which is typically intended to yield one result, into an additional result of removing a bottle cap. This makes it dramatically different from most hand tools, which require intentional manipulation to achieve a result.

What is claimed is:

1. A cap remover of the type comprising: a body of rigid material; a hook adjacent to a flat area where a cap can be couched; a ring to accommodate a finger which is connected to a finger platform; a curved rocker surface with a tapered end below said finger platform; adequate width, balance, and configuration to allow opener to position its hook under the edge of a cap without being grasped.

2. A cap remover of claim 1 which allows engagement and removal of a bottle cap through the motion of grabbing a bottle with one hand without grasping then manipulating the device.

3. A cap remover of claim 1 wherein a magnet with poles positioned parallel to and above the hook is present.

* * * * *